US011833088B1

(12) United States Patent
Foonberg et al.

(10) Patent No.: US 11,833,088 B1
(45) **Date of Patent: *Dec. 5, 2023**

(54) WHEELED CHAIR

(71) Applicant: Jay Foonberg, Beverly Hills, CA (US)

(72) Inventors: Jay Foonberg, Beverly Hills, CA (US); Allen Herbert Rosoff, Tulsa, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/856,544

(22) Filed: Jul. 1, 2022

Related U.S. Application Data

(63) Continuation of application No. 15/844,386, filed on Dec. 15, 2017, now Pat. No. 11,376,173.

(51) Int. Cl.
*A61G 5/08* (2006.01)
*A61G 5/10* (2006.01)
*A61G 5/12* (2006.01)

(52) U.S. Cl.
CPC ..... *A61G 5/0875* (2016.11); *A61G 5/0883* (2016.11); *A61G 5/1083* (2016.11); *A61G 5/128* (2016.11)

(58) Field of Classification Search
CPC .. A61G 5/0875; A61G 5/0883; A61G 5/1083; A61G 5/128
See application file for complete search history.

(56) References Cited

U.S. PATENT DOCUMENTS 2,133,540 A 10/1938 Jacobs
2,379,566 A 7/1945 Duke
2,485,016 A 10/1949 Rideout
2,621,711 A 12/1952 Leslie et al.
2,675,057 A 4/1954 Glass
2,859,800 A 11/1958 Jennings, Jr.
2,914,111 A 11/1959 Mize
2,959,212 A 11/1960 Bauer
3,021,889 A 2/1962 Mize
3,730,584 A 5/1973 Uchida
3,968,991 A 7/1976 Maclaren
4,045,051 A 8/1977 Igarashi et al.
4,140,341 A 2/1979 Rabe
4,164,354 A 8/1979 Rodaway
4,457,535 A 7/1984 Takeuchi et al.
4,515,383 A 5/1985 Minnebraker
4,770,467 A 9/1988 Zinn
4,861,056 A 8/1989 Duffy et al.
4,874,084 A 10/1989 Strausser
5,076,390 A 12/1991 Haskins
5,188,383 A 2/1993 Thompson
5,558,358 A 9/1996 Johnson
5,857,688 A 1/1999 Swearingen
6,079,725 A 6/2000 Lazaros
6,135,222 A 10/2000 Furukawa
6,270,105 B1 8/2001 Friedrich
6,302,429 B1 10/2001 Friedrich
6,540,290 B2 4/2003 Liu
7,077,422 B2 7/2006 Haury et al.
7,152,515 B1 12/2006 Greenlee
7,384,058 B2 6/2008 Munsey et al.
7,597,339 B2 10/2009 Furusho
7,607,725 B2 10/2009 Dickie et al.
(Continued)

*Primary Examiner* — Minnah L Seoh
*Assistant Examiner* — Michael R Stabley
(74) *Attorney, Agent, or Firm* — GableGotwals

(57) ABSTRACT

A kit of parts which when assembled will provide a wheeled chair and include a central frame member to which all other elements are connected.

1 Claim, 3 Drawing Sheets

(56) References Cited

U.S. PATENT DOCUMENTS

| | | | | |
|---|---|---|---|---|
| 7,669,881 | B2 | 3/2010 | Haury et al. | |
| D618,141 | S | 6/2010 | Chan | |
| D699,160 | S | 2/2014 | Yang | |
| 8,998,245 | B1 * | 4/2015 | Anooshian | A61G 5/0825 280/649 |
| 9,572,733 | B1 | 2/2017 | Lai et al. | |
| 9,629,763 | B2 | 4/2017 | Thompson | |
| 9,839,566 | B2 * | 12/2017 | Yentzer | A61G 5/02 |
| 10,399,588 | B1 | 9/2019 | Grantham, IV | |
| 2002/0127944 | A1 | 9/2002 | Spector | |
| 2004/0021298 | A1 | 2/2004 | Tsai | |
| 2005/0057021 | A1 | 3/2005 | Miyoshi | |
| 2005/0077760 | A1 | 4/2005 | Smith | |
| 2005/0248143 | A1 | 11/2005 | Sato | |
| 2007/0145723 | A1 | 6/2007 | Kamara | |
| 2007/0257484 | A1 | 11/2007 | Schindel | |
| 2008/0093821 | A1 | 4/2008 | Menichini | |
| 2008/0238041 | A1 | 10/2008 | Chen | |
| 2009/0100769 | A1 | 4/2009 | Barrett et al. | |
| 2011/0006494 | A1 | 1/2011 | Walker | |
| 2011/0240380 | A1 | 10/2011 | Zhao et al. | |
| 2011/0291387 | A1 * | 12/2011 | Chang Liao | A61G 5/1067 280/647 |
| 2012/0007341 | A1 | 1/2012 | Masaki | |
| 2013/0202254 | A1 | 8/2013 | Gurreri | |
| 2016/0106606 | A1 | 4/2016 | Eddy et al. | |
| 2016/0270989 | A1 | 9/2016 | Yentzer et al. | |
| 2016/0325585 | A1 | 11/2016 | Hays et al. | |
| 2017/0105070 | A1 | 4/2017 | O'Polka | |
| 2017/0281437 | A1 | 10/2017 | Itano | |
| 2018/0023309 | A1 | 1/2018 | Brawner et al. | |
| 2018/0042794 | A1 | 2/2018 | Itano | |
| 2018/0042795 | A1 | 2/2018 | Itano | |
| 2018/0168898 | A1 | 6/2018 | Foonberg et al. | |
| 2018/0221242 | A1 | 8/2018 | Lee et al. | |
| 2018/0296408 | A1 | 10/2018 | Sato | |

* cited by examiner

WHEELED CHAIR

BACKGROUND OF THE INVENTION

1. Field of the Invention

The present invention relates to transport chairs and, more particularly, a transport chair that can be provided in parts that can be easily assembled and disassembled without the need for tools. The disassembled parts can be stored and carried as a relatively small package.

2. General Background and State of the Art

Transport chairs in general and wheel chairs in particular tend to be large with accessories and, in some instances, can be motorized. Such chairs are used for ill or disabled persons who are unable to walk comfortably or are easily fatigued by walking.

Wheel chairs are conventionally constructed with a pair of large rear wheels accessible to the user and smaller front wheels. The large wheels can be manipulated by the occupant of the chair. Such chairs can also be pushed by an assistant. Some chairs are designed to collapse axially, resulting in a narrower frame that can be stored or transported. Most transport chairs that do not have the large wheels require an attendant to maneuver the chair. Some however permit the user, while recumbent, to propel the chair with the feet.

Travel, for a person who needs a wheeled chair, has always been difficult. Travel by air has become more and more difficult as airlines maximize the aircraft loads and impose baggage charges which travelers try to avoid by bringing more articles into the aircraft, itself. Under the Americans with Disabilities Act ("ADA"), an airline is only required to have one wheeled chair to assist passengers to a seat or to a lavatory. There may or may not be space for one passenger's collapsible wheel chair, usually at a bulkhead separating first class from the rest of the cabin. Unless there is room for an additional chair, which is highly unlikely under present travel conditions, any other passengers with wheel chairs are required to check the chairs as baggage to be retrieved off the plane in the baggage claim area or other of the destination airport.

If a wheel chair must be checked as baggage, the person needing the chair is faced with the problem of boarding the aircraft. The airport is responsible for the provision of a wheel chair to get a passenger to and from the aircraft. This process may be time consuming, especially if more than one passenger in the airport requires assistance. At the aircraft, the on board wheel chair can be used to take the passenger to an assigned seat. A passenger's collapsible wheel chair, in most cases, cannot be used on the aircraft as it will probably be too wide for the aisle.

At the destination, if the passenger can be wheeled to the aircraft door, it is the responsibility of the airport to provide a wheel chair to take the passenger from the plane to the baggage claim area, if the passenger's own chair was not stowed in the cabin. In the baggage claim or other If the airport fails to provide assistance due to overload or poor scheduling on any reason, the passenger will be abandoned to their own resources at which point the chair become critical.

area, the passenger can be reunited with the checked wheel chair, which, if undamaged, can be used for subsequent transport.

Transport chairs, generally, do not travel well. If checked as baggage by airlines, they are subject to the luggage handling treatment normally afforded checked baggage and may be damaged or misdirected. Unless especially designed to be accommodated by passenger aircraft, a personal chair may not be provided on commercial aircraft. Although passage of the ADA has required public facilities to be accessible to transport chairs, a great many activities are still beyond the convenient reach of persons with debilitating conditions. What is needed is a transport chair where there are:

1. No tools necessary to collapse or assemble the chair
2. Less than 15 parts to be "slipped" or fitted together with no catches; 3. The parts are numbered, color coded or otherwise associated and will not be interchangeable, thus making it impossible to misconnect any pieces;
4. No physical strength required to assemble. A senior citizen with severe arthritis and very little finger mobility will be able to assemble and collapse the chair;
5. No great intellectual ability needed to assemble or collapse. Just be able to match the pre colored and numbered parts so color blindness will not be an obstacle;
6. The chair and a carrying case with wheels (roller board) or cases together will fit within both the weight and size bin limitations of most airlines for carry on baggage; No need to trust airline baggage handling systems or people and the chair will never be outside of sight or possession of the passenger.
7. The chair and case or cases together will easily fit into the trunk or back seat of the smallest compact or sports cars, or the overhead bin of an airplane or under bed
8. Grandparents and all seniors need not be left behind. They can join a cruise or a family outing or the group as they wish. (Cruises only provide assistance with getting the wheel chair person on or off the boat. They don't provide chairs for use either on or off the boat). If the destination hotel or other destination does not have suffice wheels chair this chair in its roller board case can immediately be retrieved from the trunk and use.
9. The chair of the present invention can also be a stroller for small children, making travel easier for parents who would otherwise travel with bulky strollers.
10. Assembly and disassembly is not a lengthy procedure but can be accomplished in a few minutes.

SUMMARY OF INVENTION

According to the present invention, a kit of parts is created which, when assembled, results in a wheeled chair of a size that can transport an adult but is easily accommodated by most passenger aircraft, buses, vans and other vehicles. In the preferred embodiment, the individual parts are mostly constructed of tubing which may be square, rectangular or circular. Most parts that are intended to fit together are telescopically coupled. For safety, locking pins can be placed in aligned holes in both parts, preventing accidental separation. Insertion can be limited by internal stops within the female members.

The parts assemble into left and right frames which are joined by horizontal cross members. Wheels are added at the bottom of the two frames and handles can be inserted into the tops of the frames. A fabric seat panel also joins the frames together. A fabric back panel joins the two handle members which can be inserted into the top of the frames.

Using coloring coding, any child over the age of 7 should be able to assembly or disassemble the chair.

Each part will have indexing features that may include a color code, alpha numeric designation, symbols or other markings. Parts that mate will have matching indicia to avoid the possibility of a mismatch. While color coding is generally satisfactory, additional indicia will be supplied so that the color challenged may still be able to assemble the chair. The tubing is sized so that members can mate telescopically.

In alternative embodiments, round tubing may be used with reduced diameters for the "male" end that is to fit into the "female" end. In all embodiments, tubing can be utilized with the "male" end having a reduced perimeter so that it might be fitted into the "female" end. In some embodiments, printed or etched lines may be used to gauge the extent of insertion. Splines and grooves may be utilized to assure that apertures in the mated parts are aligned so that locking pins can be easily inserted In alternative embodiments, other materials can be used, such as carbon fiber tubing. However, with other materials, other methods of coupling parts together. It may necessitate special interface devices to assure a tight, wobble free fit.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

DETAILED DESCRIPTION OF THE PREFERRED EMBODIMENTS

Figure 1:
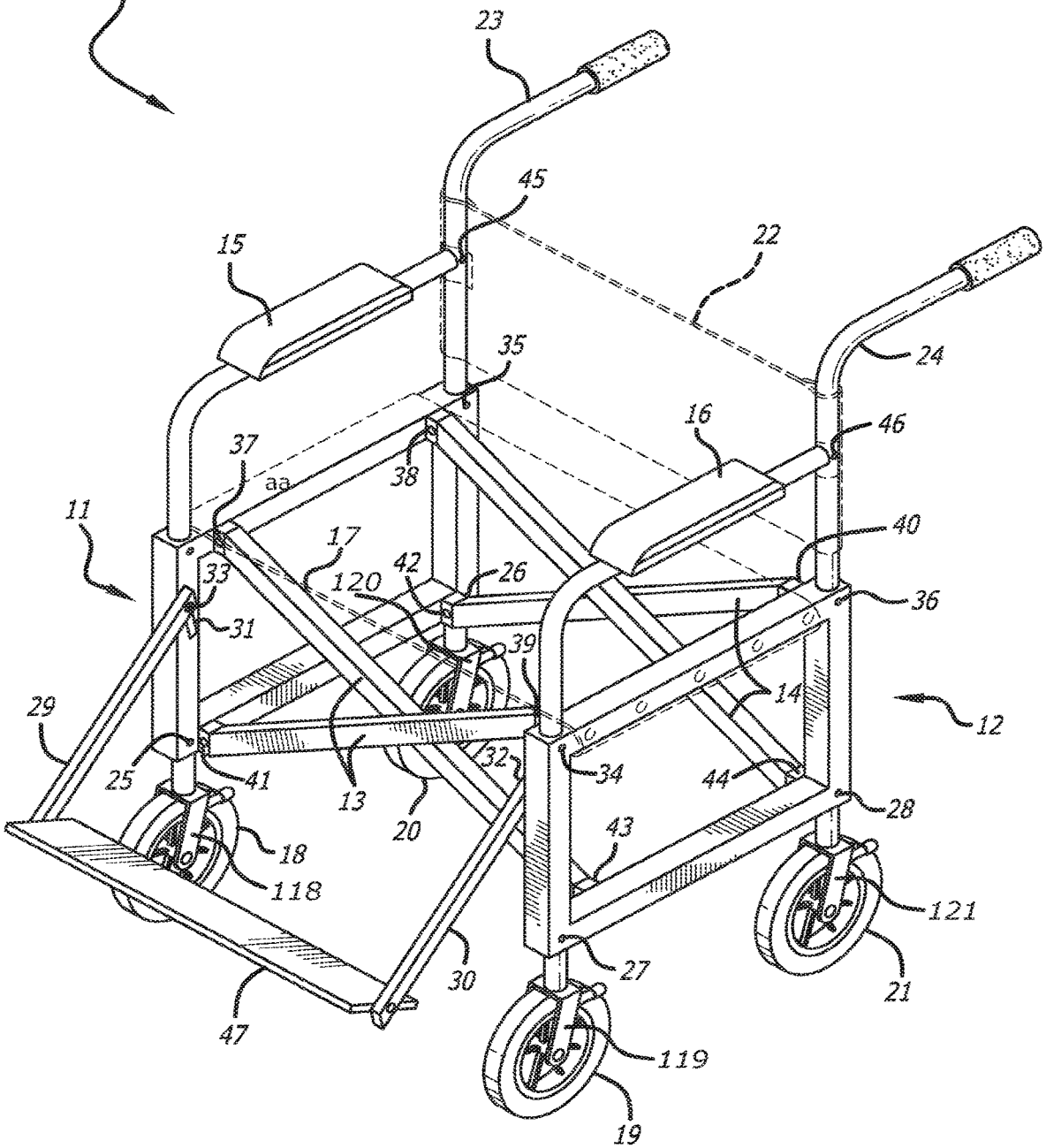
FIG. 1 is a perspective view of a chair according to the present invention.

Turning first to FIG. 1, there is shown a wheeled chair 10, according to the present invention. The chair 10 is assembled from component subassemblies. A left and right rigid frame unit 11, 12 can be a starting point which in the preferred embodiment is square tubing horizontally and round tubing vertically. They are connected by front and rear cross members 13, 14 through mounting clips with locking pins 37, 38, 39, 40, 41, 42, 43, 44 (not shown in detail). A seat panel 17 (shown in dashed lines so that the other structural members are visible) joins the left and right rigid frame units 11, 12 spanning across the top. The front wheels 18, 19 are inserted into the lower front end of the rigid frame units 11, 12 and are secured with locking pins 25, 27 respectively.

Rear wheels 20, 21 are inserted into the lower rear end of the rigid frame units 11, 12 and are secured with locking pins 26, 28 respectively. A back support panel 22 (shown in dashed lines so that other structural members are visible) spans between the push handle support tubing 23, 24. The push handle support tubing 23, 24 is inserted into the upper rear end of the rigid frame units 11, 12 and is secured with locking pins 35, 36 respectively.

The left and right armrests 15, 16 with their support tubing are inserted into the upper front end of the rigid frame units 11, 12 and secured with locking pins 33, 34 respectively. The rear end of the left and right armrest tubing 15, 16 is slotted (not shown) and locks in place over tabs (not shown) welded to the push handle support tubing 23, 24 with locking hooks 45, 46 respectively.

The footrest 47 with supporting arms 29, 30 are mounted (hung) on the front of the rigid frame units 11, 12 by sliding onto the armrest locking pins 33, 34 respectively. The forward position of the footrest is held in place by the left and right locking bars 31, 32 (not detailed). Front and rear wheel locking pins 25, 26, 27, 28 (not shown in detail) are spring loaded and welded to the lower front and rear of the rigid frame units 11, 12 respectively. The locking pins 25, 26, 27, 28 have a pull ring attached for releasing them and securing them. Locking pins for cross bracing 13, 14, push handle supports 23, 24 and armrest supports 15, 16 have center buttons which control expansion and contraction of ball bearings at the end of the pins for locking them into place.

Figure 2:
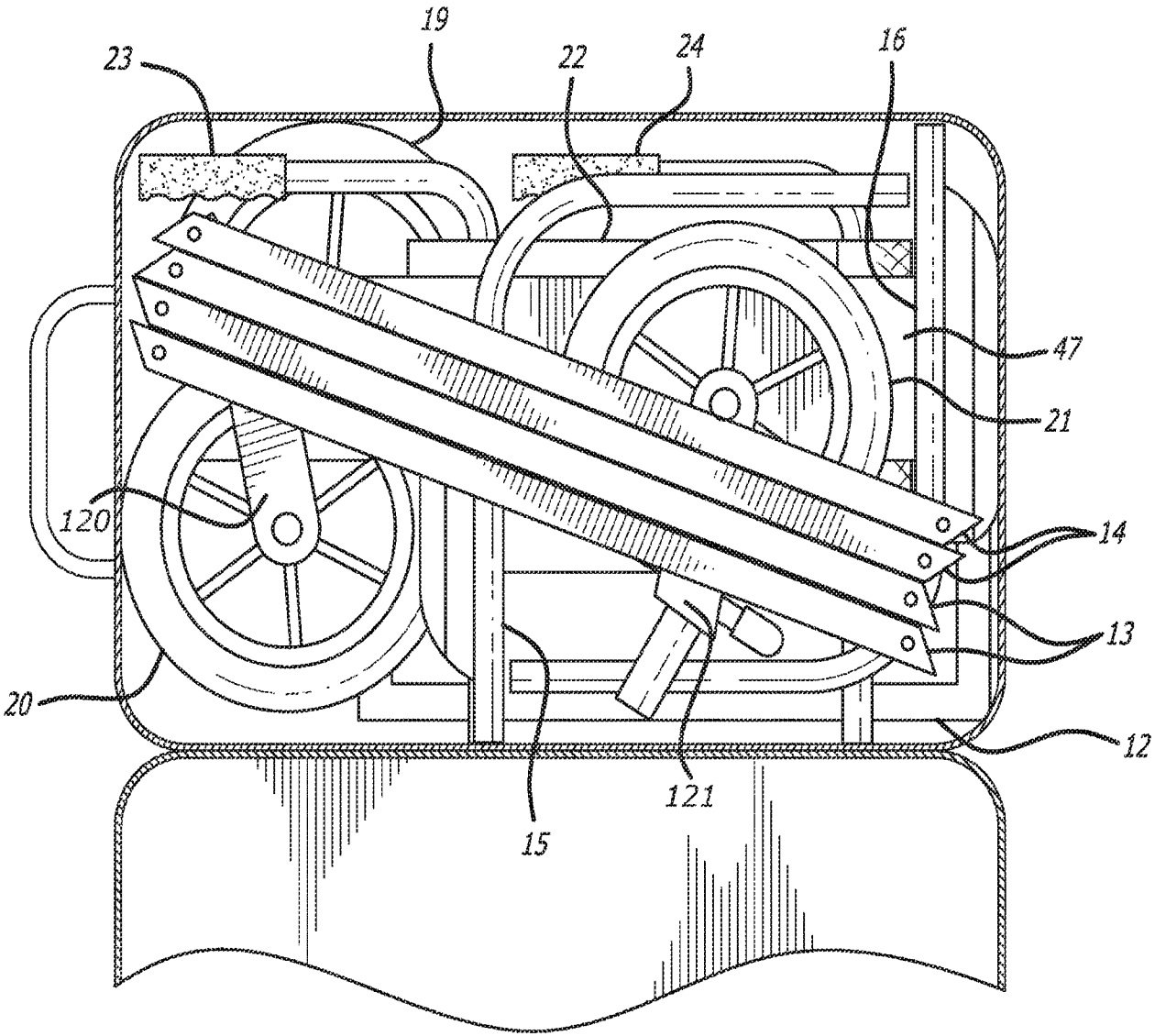
FIG. 2 is a top view of the disassembled component parts arranged for transport.
Figure 3:
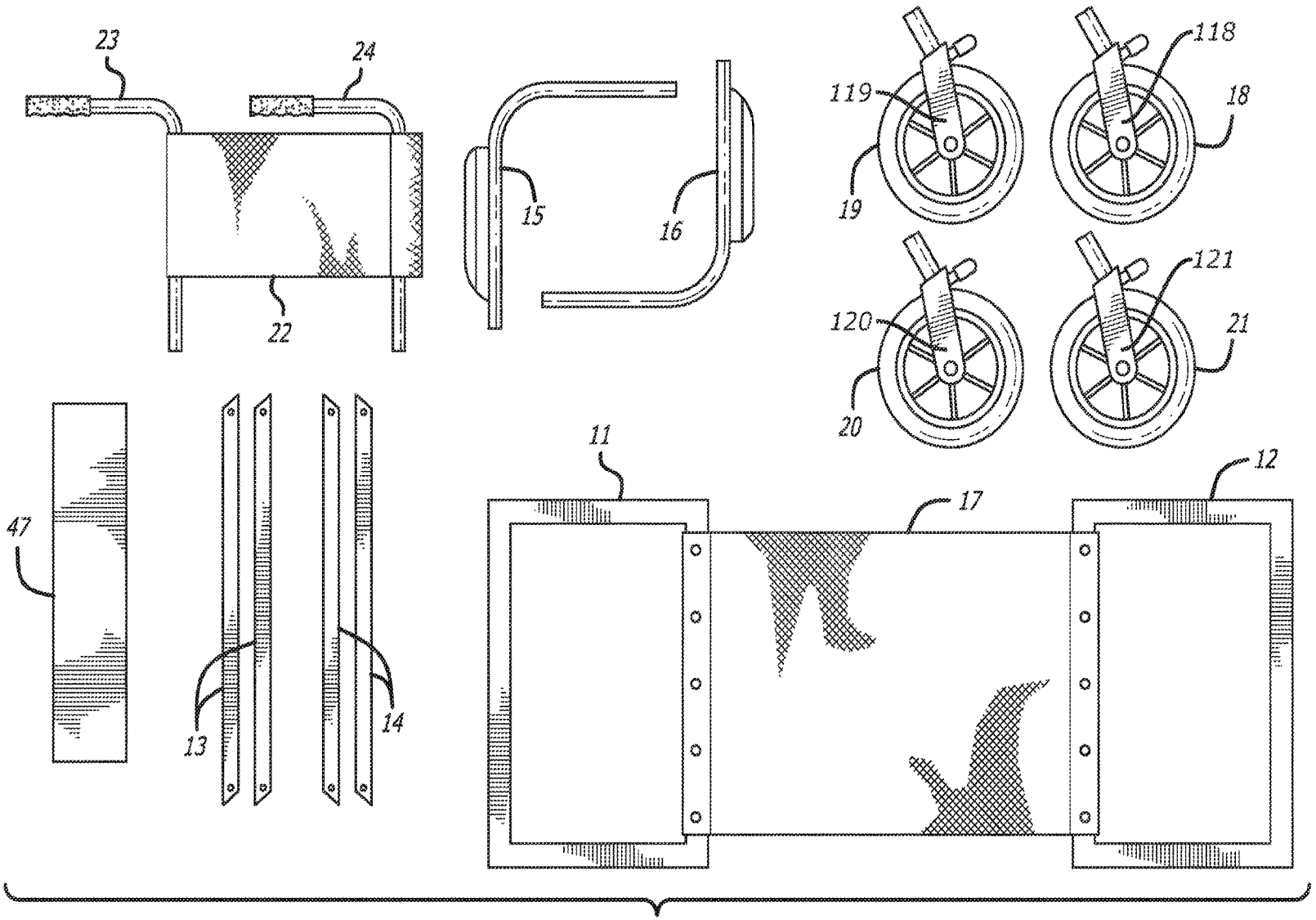
FIG. 3 is a perspective view of all of the components in an array.

FIG. 2 shows the various parts arranged in a compact configuration for transport, either in a suitcase or one or more bags sized to meet aircraft carry-on luggage limitations. It is the goal of the present invention to provide a kit of parts that can be easily stowed in an aircraft overhead bin and yet be easily and quickly assembled for the use of a passenger who needs the chair for transport from the aircraft if the stowed chair is unavailable In FIG. 3, all of the component parts are displayed in an array. Although the seat panel 17 was shown in dashed lines in FIG. 1, it is shown here fastened to the rigid frame units 11, 12. Similarly, the left and right armrests can be seen with their support tubing 15, 16. The back support panel 22 shown in dashed lines in FIG. 1 is here seen as attached to the push handle support tubing 23, 24.

While specific examples of locking mechanisms have been described, alternatives are available. For example, spring loaded hemispheres on the ends of the female members can engage apertures in the ends of the male members. Other proprietary fasteners are available to assure a stable connection. Indices of various types can be employed to assure that parts intended to be joined are not mismatched. Embodiments using lighter weight materials may need additional elements for assembly and disassembly. However, all such modifications are within the scope of the present invention.

While the specification describes particular embodiments of the present invention, those of ordinary skill can devise variations of the present invention without departing from the inventive concept. It is also within the scope of the present invention to provide motors to drive the wheels so that a collapsible and transportable chair can be motorized.

What is claimed is:

1. A transport chair frame moveable between a disassembled stowed state and an assembled deployed state, the transport chair frame comprising:

a plurality of locking pins;

a left fixed side and a right fixed side, each fixed side being rectangular in shape and having a top, a bottom, a front, and a back;

a pair of front cross braces and a pair of rear cross braces;

the left and right fixed sides each including means along the top for receiving an armrest and means along the bottom for receiving wheels;

wherein, in the assembled deployed state:

the left fixed side is spaced apart from, and arranged opposite, the right fixed side;

for each pair of front cross braces and for each pair of rear cross braces:

one of the cross braces of the pair is connected to the top of the left fixed side and to the bottom of the right fixed side;

another one of the cross braces of the pair is connected to the bottom of the left fixed side and to the top of the right fixed side;

the pair of front cross braces and the pair of rear cross braces located, respectively, toward the front and the back of the left and right fixed sides;

each connection of the transport chair frame when in the assembled deployed state being by way of a locking pin of the plurality of locking pins;

wherein, no tools are required to move the transport chair frame between the disassembled stowed state and the assembled deployed state; and, wherein, when in the disassembled stowed state, the front and rear cross braces, being disconnected from the left and right fixed sides and forming a kit of parts including the plurality of locking pins.

* * * * *